US005363834A

United States Patent [19]

Stuchlik

[11] Patent Number: 5,363,834

[45] Date of Patent: Nov. 15, 1994

[54] GUN POWERED BY EITHER COMPRESSED GAS CARTRIDGE OR HAND-PUMPED AIR

[75] Inventor: William R. Stuchlik, Rogers, Ark.

[73] Assignee: Daisy Manufacturing Company, Inc., Rogers, Ark.

[21] Appl. No.: 39,994

[22] Filed: Mar. 30, 1993

[51] Int. Cl.[5] ..... F41B 11/06; F41B 11/26; F41B 11/28; F41B 11/32

[52] U.S. Cl. ..... 124/76; 124/69; 124/73; 124/74

[58] Field of Search ..... 124/69–74, 124/76

[56] References Cited

U.S. PATENT DOCUMENTS

| | | | |
|---|---|---|---|
| 452,882 | 5/1891 | Giffard . | |
| 1,214,398 | 1/1917 | Welch | 124/69 |
| 1,818,810 | 8/1931 | Miller | 124/70 X |
| 2,537,358 | 1/1951 | Lincoln . | |
| 2,566,181 | 8/1951 | Fitch . | |
| 2,652,821 | 12/1944 | Fitch . | |
| 3,763,843 | 10/1973 | Fisher et al. . | |
| 3,800,773 | 4/1974 | Fischer . | |
| 3,802,408 | 4/1974 | Joyce . | |
| 3,810,455 | 5/1974 | Garmon, Jr. . | |
| 3,855,990 | 12/1974 | Joyce et al. . | |
| 4,344,410 | 8/1982 | Curran . | |
| 4,865,009 | 9/1989 | Ford et al. . | |
| 4,890,597 | 1/1990 | Ekstrom | 124/74 |

FOREIGN PATENT DOCUMENTS

| | | |
|---|---|---|
| 2602455 | 8/1977 | Germany . |
| 3704455 | 8/1988 | Germany . |

*Primary Examiner*—Randolph A. Reese
*Assistant Examiner*—John A. Ricci
*Attorney, Agent, or Firm*—Banner, Birch, McKie & Beckett

[57] ABSTRACT

A gun having a first mode of operation for propelling the projectile by compressed gas contained within a cartridge and a second mode of operation for propelling the projectile by air compressed by a self contained pumping mechanism. A switching system is provided for switching between the first and second modes. The switching system includes a valve having a first position corresponding to the first mode of operation and a second position corresponding to the second mode of operation. The first position allows compressed gas from the cartridge to propel the projectile and the second position prevents compressed gas from the cartridge from propelling the projectile and allows the projectile to be propelled by compressed air from the pumping mechanism. A switch member is provided for positioning the valve in the first and second positions. The switch member is capable of being actuated by the gun operator to switch the gun between the first and second modes.

24 Claims, 8 Drawing Sheets

GUN POWERED BY EITHER COMPRESSED GAS CARTRIDGE OR HAND-PUMPED AIR

BACKGROUND OF THE INVENTION

This invention relates to guns using compressed gas to power a projectile, and more particularly, to a gun capable of powering a projectile by either air compressed by a hand pump mechanism or a compressed gas contained in a cartridge. The gun also has a switching mechanism operated by a user for switching between the hand pumping mechanism and the compressed gas cartridge. Thus, the present invention offers the user the versatility of propelling a projectile from a gun using either air compressed by a hand pump or compressed gas contained in a cartridge and offers this versatility by the simple actuating of a switch.

Guns have been provided with a hand pump to compress air to propel a projectile (such as a BB or pellet) in the past. For example, U.S. Pat. No. 3,802,408 describes a gun having a pump handle and pump mechanism for compressing air to propel a projectile. The pump handle is actuated by the gun's operator to compress the air. Guns have also been provide with compressed gas cartridges for propelling a projectile. For example, U.S. Pat. No. 4,344,410 describes a gun having a cartridge filled with compressed carbon dioxide to power a projectile.

U.S. Pat. Nos. 2,566,181 and 2,652,821 describe a gun powered by solid carbon dioxide disposed in a reservoir. The gun is also described as having an operating handle for actuating a piston in a cylinder to increase the pressure of the carbon dioxide by further compressing the carbon dioxide. These patents further state that it is also contemplated that it may be desirable to operate the gun in the event of failure of the supply of gaseous carbon dioxide and that this may be readily accomplished by removing the plug from the lower end of the reservoir whereupon the piston and the cylinder will act solely as a compressed air pump receiving air from the atmosphere through the reservoir and the passage and compressing this air in the firing reservoir.

U.S. Pat. No. 1,214,398 describes a gun having a flask containing air under pressure to propel a projectile. The patent states that a lever is raised to open a charging valve and the result being that high pressure air from the flask flows along an air line, through an outlet which is uncovered by a valve, and into a charging chamber. The charging valve is held open until the charge in the chamber drives a piston forward and compresses a cushion. When this occurs, the valve is drawn over the outlet and further admission of high pressure air is automatically cut off. The lever is then restored to its normal position. The patent further states that for manually increasing the air pressure in the discharge chamber, as for instance when the pressure in the flask begins to run low, an additional means is provided in the shape of a pump which may well be actuated at will. The patent states that when the operator grasps the grip and manipulates the lever, the piston is reciprocated within its cylinder, air is drawn in and forced out and flows along a line to the discharge chamber.

SUMMARY OF THE INVENTION

One object of the invention is to provide a gun that can propel a projectile by either a compressed gas contained in a cartridge or air compressed by a hand pump mechanism.

Another objective of the invention is to provide a switching mechanism that allows the gun operator to easily switch the power source from the compressed gas cartridge to the hand pump mechanism and vice versa.

A further objective of the invention is to provide a gun where the hand pump mechanism is prevented from being operated when the gun is to be powered by the compressed gas cartridge and where insertion of a compressed gas cartridge is prevented when the gun is to be powered by the hand pump mechanism.

Still another objective of the invention is to provide a mechanism for venting residual gas from a gun's storage chamber when switching the power sources from the compressed gas cartridge to the hand pump mechanism and vice versa.

According to the present invention, the foregoing and other objects are attained by a gun for propelling a projectile using compressed gas including a gun body and a barrel attached to the gun body. The barrel has a bore through which the projectile is propelled. A compressed gas storage chamber is disposed in the gun body and, when the gun is fired, the storage chamber is in fluid communication with the barrel bore through a passage. A firing valve for allowing the compressed gas in the storage chamber to pass through the passage to the barrel bore to propel the projectile is provided and opens in response to the firing of the gun. A compression chamber is provided and is in fluid communication with the storage chamber through a check valve. The compression chamber has a piston disposed therein. The piston is capable of being reciprocated in the compression chamber to compress atmospheric air and the check valve allows air compressed in the compression chamber by the reciprocation of the piston to pass into the storage chamber. An access port is disposed in the storage chamber. A compressed gas cartridge holder capable of holding a compressed gas cartridge is provided. An entry port is provided and is in fluid communication with the compressed gas cartridge when the cartridge is held in the cartridge holder. The access port is also in fluid communication with the entry port. A switching valve is disposed in the gun body and is capable of being actuated by a gun operator between a first and second position. The first position allows fluid communication between the entry port and the access port such that compressed gas continuously flows from the cartridge to the storage chamber when the compressed gas cartridge is disposed in the cartridge holder. The second position prevents fluid communication between the entry port and the access port.

In accordance with another aspect of the invention, the gun has a first mode of operation for propelling the projectile by compressed gas contained within a cartridge and a second mode of operation for propelling the projectile by air compressed by a self contained pumping mechanism. A switching system is provided for switching between the first and second modes. The switching system includes a valve having a first position corresponding to the first mode of operation and a second position corresponding to the second mode of operation. The first position only allows compressed gas from the cartridge to propel the projectile and the second position prevents compressed gas from the cartridge from propelling the projectile and only allows the projectile to be propelled by compressed air from the pumping mechanism. A switch member is provided for positioning the valve in the first and second positions. The switch member is capable of being actuated by the gun operator to switch the gun between the first and second modes.

In accordance with another aspect of the invention, a gun for propelling a projectile using a compressed gas has a gun body and a barrel attached to the gun body. The barrel has a bore through which a projectile is propelled. A valve body is disposed in the gun body and has a bore formed therein. The bore is connected to the barrel bore by a passage. A firing valve is disposed at the juncture between the passage and the valve body bore. The firing valve allows fluid communication between the valve body bore and the barrel bore when the gun is fired. A compression chamber is provided for compressing atmospheric air and a check valve is disposed between the compression chamber and the valve body bore such that a compressed gas storage chamber is formed by the valve body bore and the check valve. A piston is disposed in the compression chamber and is capable of reciprocation within the compression chamber to compress atmospheric air. The reciprocation of the piston forces compressed air through the check valve and into the storage chamber. An access port is disposed in the valve body bore and a compressed gas entry port is provided and adapted to be in fluid communication with a compressed gas cartridge. A switching valve body is disposed in the gun body and has a first bore and a second bore. The first bore is in fluid communication with the access port and the second bore is in fluid communication with the entry port. A switching valve member is provided and has a first position for allowing fluid communication between the first and second bores and a second position for preventing fluid communication between the first and second bores.

Additional objects, advantages and novel features of the invention will be set forth in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

DETAILED DESCRIPTION OF THE PREFERRED EMBODIMENTS

Referring to FIG. 1–20, the invention will be described with respect to a rifle, although the invention can also be used in a pistol or other gun format. The invention is also described for a gun for propelling a BB or pellet. However, the invention applies equally as well for other projectiles, such as paint balls or darts.

RECEIVER ASSEMBLY

Figure 1:
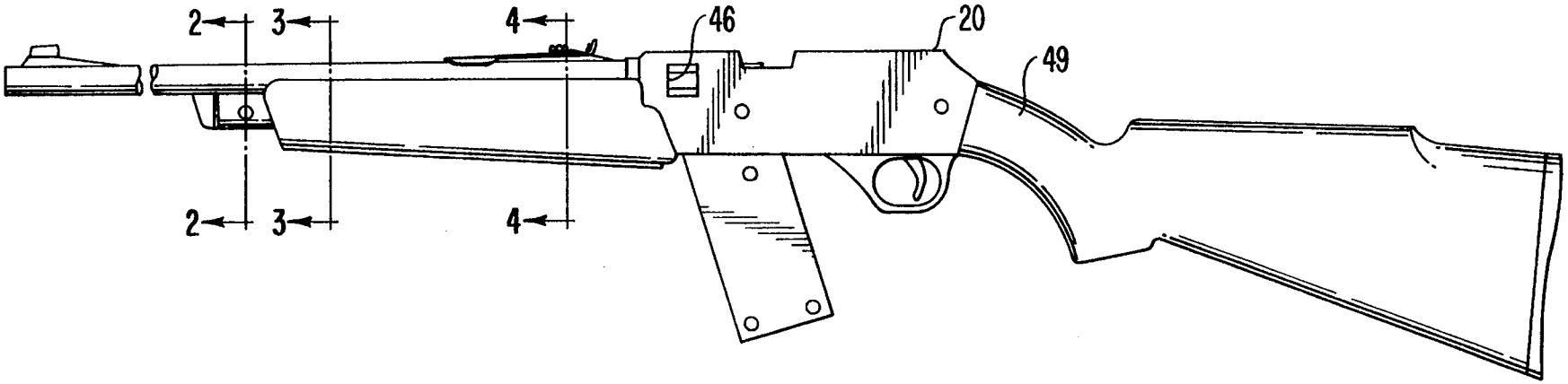
FIG. 1 is a side elevational view of a gun formed in accordance with the present invention.
Figure 5:
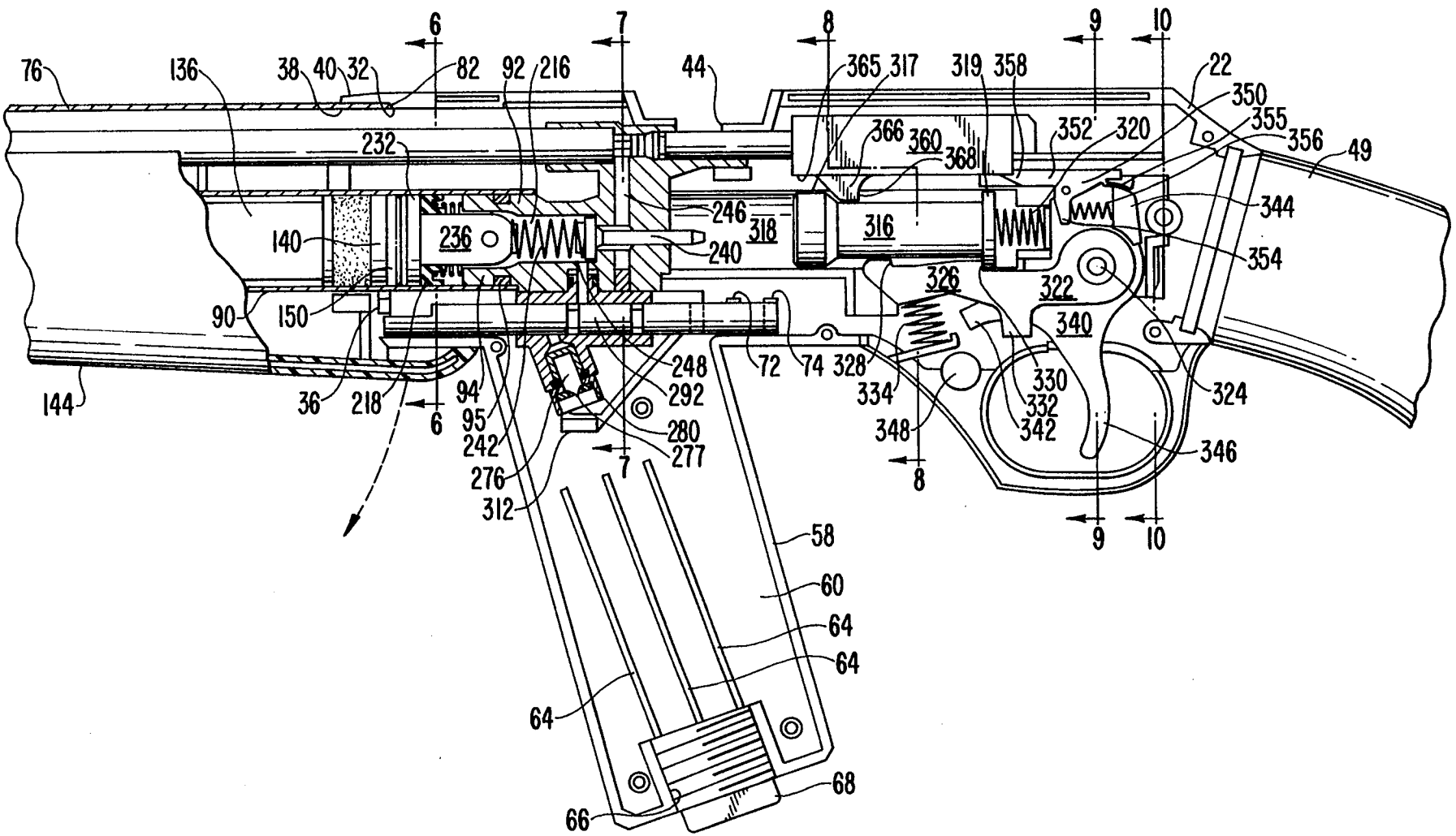
FIG. 5 is a partial side elevational view, partly in section, of the gun in FIG.1 with the gun in the pneumatic mode of operation and in the cocked position.
Figure 17:
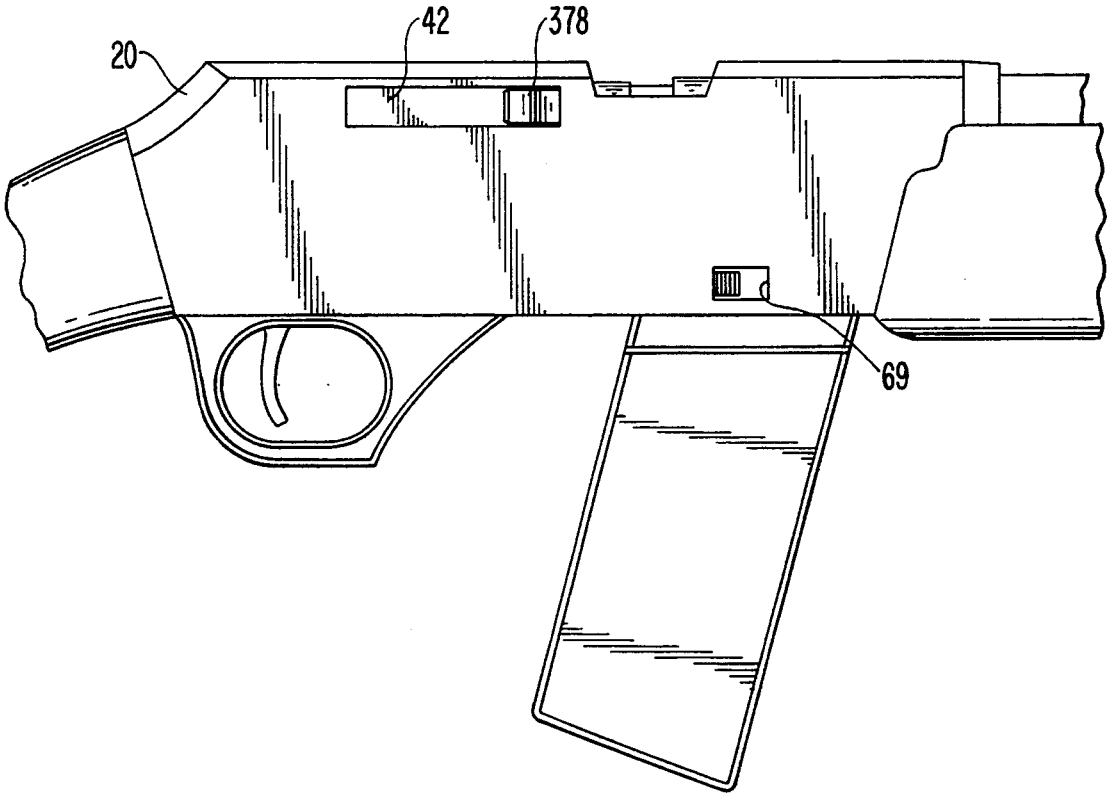
FIG. 17 is a partial side elevational view of the other side of the gun in FIG. 1.
Figure 18:
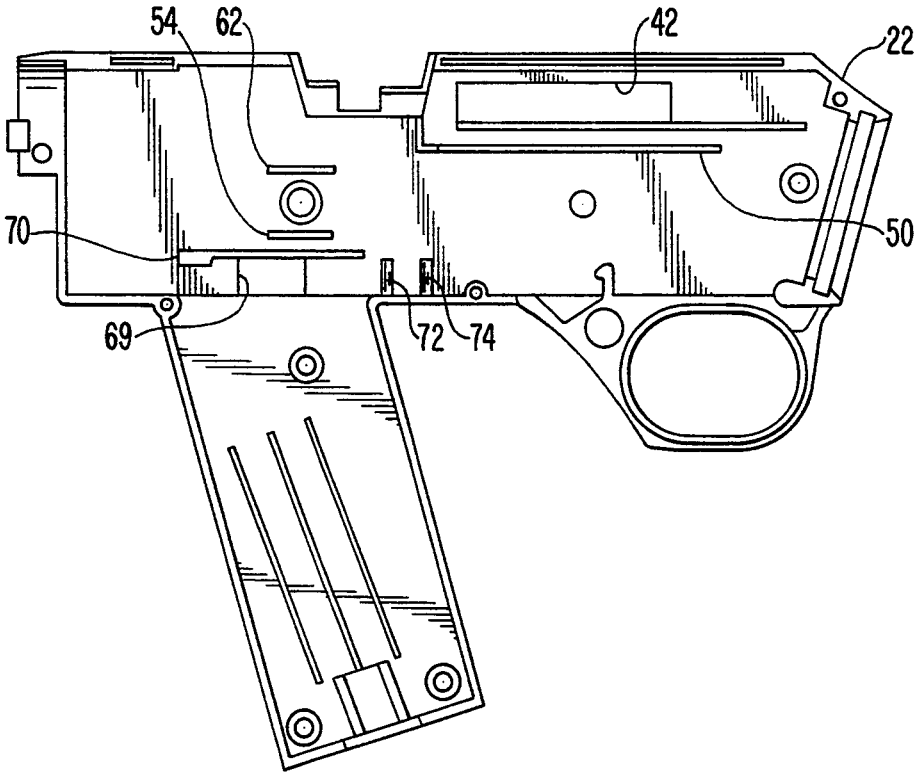
FIG. 18 is a top plan view of the inside of a receiver half of the gun in FIG. 1.

The gun mechanism is housed in a metallic receiver assembly 20 comprising nested receiver halves 22, 24 (FIGS. 5 and 6) held together by suitable fastening devices 26, 27, 28 (FIGS. 7 and 10) and providing an elongated mechanism enclosure 30 having a generally rectangular cross-sectional configuration. A barrel and pump housing opening 32 is provided in a front wall 36 of the receiver assembly located rearwardly of forwardly facing recess 38 provided by rim 40 (FIG. 5). A bolt handle opening 42 is provided on one side of the receiver assembly (FIGS. 17 and 18). In addition, an access opening 44 is located forwardly of the bolt handle opening on the top of the receiver assembly 20 (FIGS. 5 and 17). Another access opening 46 may be provided on the opposite side (FIG. 1). A trigger opening 48 (FIG. 9) is provided at the bottom of the receiver assembly and suitable stock attachment means 49 are provided at the rear. A bolt guideway rib 50 (FIGS. 8 and 9) is provided on one side of the receiver assembly and support ribs 52, 54 (FIGS. 7 and 18) are provided on opposite inner surfaces of the receiver assembly.

Figure 11:
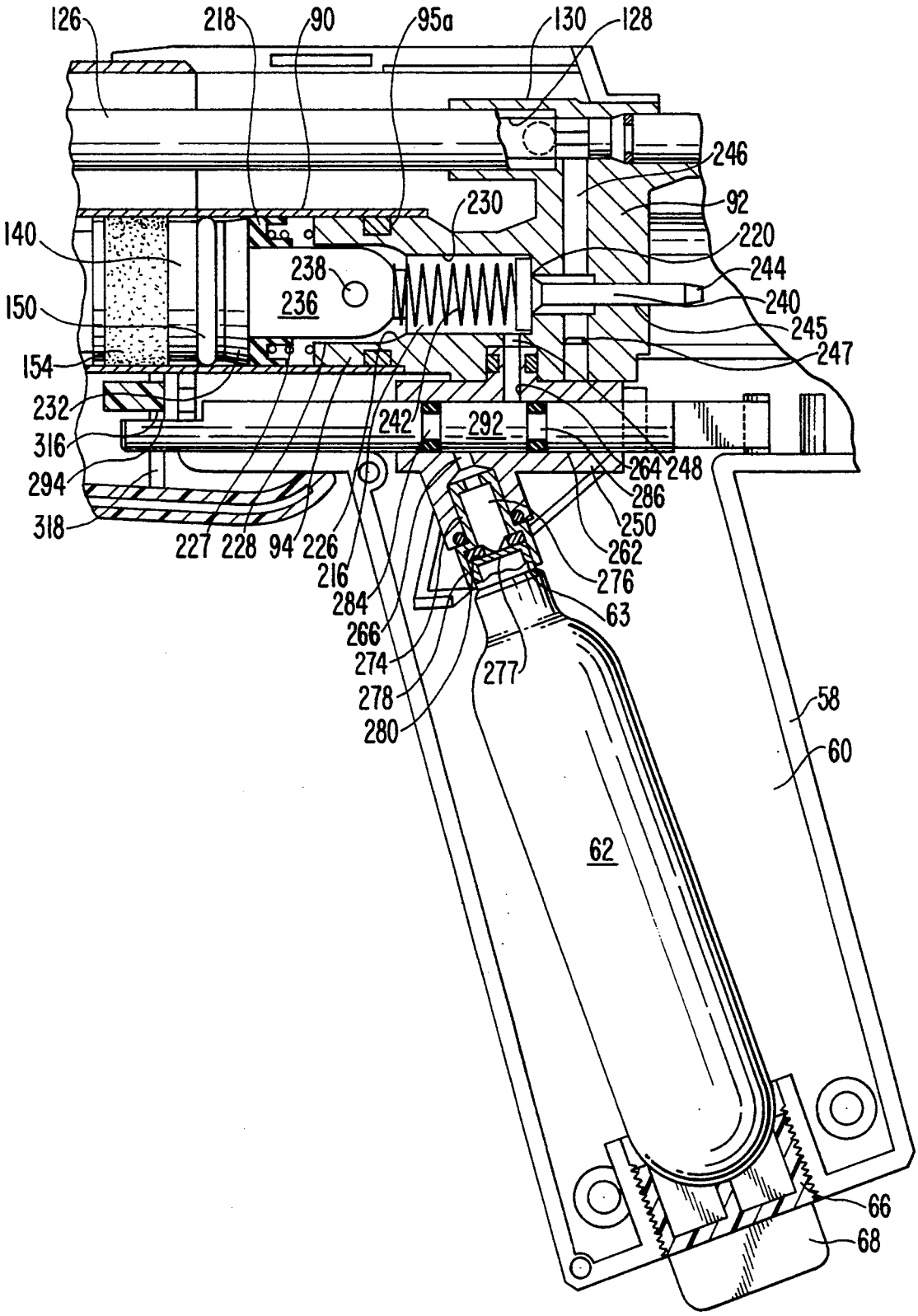
FIG. 11 is a partial side elevational view, partly in section, of the gun in FIG. 1 with the gun in the carbon dioxide mode of operation and in the cocked position.

The receiver assembly also includes carbon dioxide magazine or holder 58 extending from its lower surface. Carbon dioxide magazine 58 forms a cavity 60 for holding a conventional carbon dioxide cartridge 62 (FIGS. 5 and 11). Carbon dioxide cartridge 62 is supported in magazine 58 by supporting ribs 64 extending from the opposite inner surfaces of the receiver assembly. A threaded aperture 66 is provided at the bottom of magazine 58 to allow for insertion of cartridge 62 into magazine 58. Cartridge 62 is held in place and forced upwardly by plug 68. Screwing plug 68 upwards provides the force necessary to puncture cartridge 62, and thus, allow carbon dioxide into the gun's valving system.

The receiver assembly also includes switch aperture 69 on one side and switch supporting rib 70 disposed on the inside surface of each of the receiver halves (FIGS. 17 and 18). The assembly further has switch holding grooves 72, 74 which correspond to the carbon dioxide and pneumatic modes of operation, respectively.

HOUSING ASSEMBLY

Figure 4:
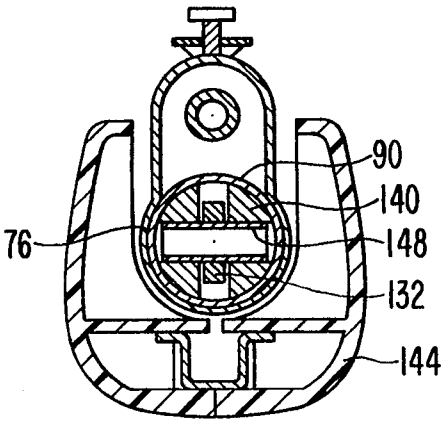
FIG. 4 is a cross sectional view taken along line 4—4 of FIG. 1.
Figure 3:
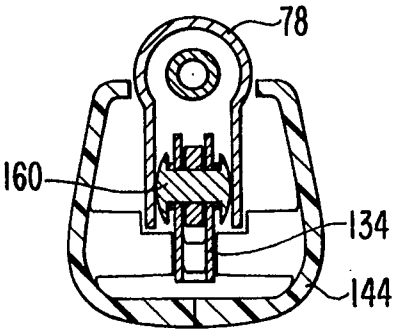
FIG. 3 is a cross sectional view taken along line 3—3 of FIG. 1.
Figure 7:
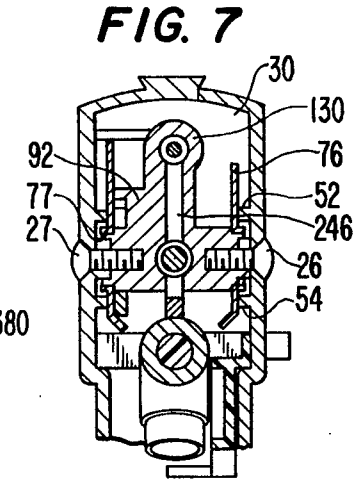
FIG. 7 is a cross sectional view taken along line 7—7 of FIG. 5.

A pump assembly housing 76 extends within and forwardly of the receiver assembly through opening 32. Housing assembly 76, as it extends forwardly, forms outer barrel portion 78 (FIGS. 3, 5 and 7). Housing assembly 76 is supported in between receiver halves 22, 24 by the alignment of apertures 77 of the housing assembly with fastening devices 26, 27 and by inwardly extending ribs 52, 54 such that the housing assembly is in spaced relationship to the side walls of the receiver assembly. A BB storage chamber 80 (FIG. 6) may be provided within the housing opposite opening 46 and connected by a conventional shot feed tube-partition assembly (not shown) to the barrel bore to enable the gun to fire BB type ammunition. A molded plastic BB loading door 81 may be slidably mounted between the adjacent side walls of the receiver and the housing. The upper curved wall of the housing terminates at 82 (FIG. 5). The housing assembly has generally parallel side wails 89*a* and 89*b* extending through the receiver assembly 20. The bottom curved wail of the housing supports an elongated tubular cylinder member 90 disposed therewithin (FIG. 4).

VALVE BLOCK ASSEMBLY

Figure 10:
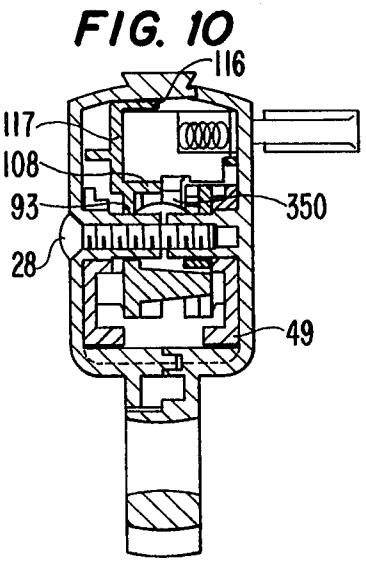
FIG. 10 is a cross sectional view taken along line 10—10 of FIG. 5.
Figure 9:
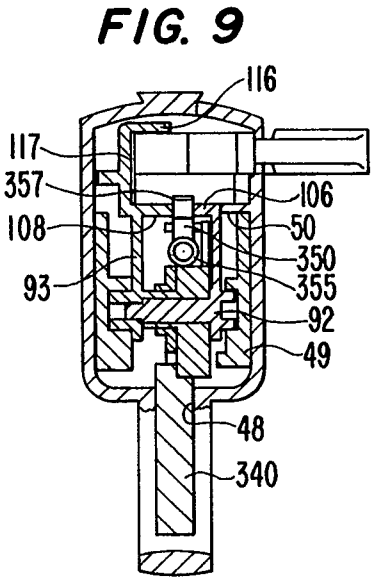
FIG. 9 is a cross sectional view taken along line 9—9 of FIG. 5.
Figure 8:
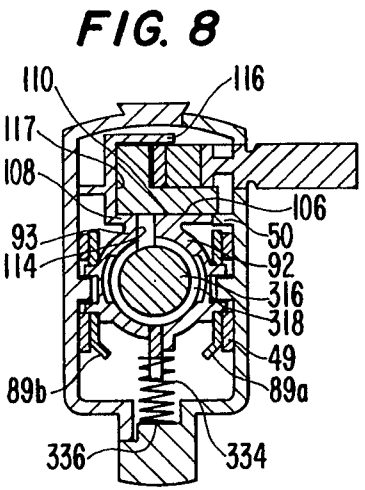
FIG. 8 is a cross sectional view taken along line 8—8 of FIG. 5.

A valve body 92 has cylindrical flange portion 94 closely fitted within the rear end of cylinder 90 (FIGS. 5 and 11). An O-ring 95 disposed in slot 95*a* on valve body 92 provides a sealing arrangement between flange portion 94 and cylinder 90. Valve body 92 contains the compressed gas (be it air or carbon dioxide) supply system and the cocking and firing system, both of which will be further described below. Valve cover 93 (FIGS. 8–10) snaps into place onto valve body 92 and holds the cocking and firing system in place. Valve body 92 has an upper wail 106. Rib 108 of valve cover 93, upper wail 106, and rib 50 extending from receiver half 22 provide a bolt slide surface 110 (FIGS. 8–10). A hammer cocking slot 114 is formed on the bolt slide surface 110. Valve cover 93 also has an upwardly extending hood 116 which provides an elongated bolt guideway 117. The valve body 92 and cover 93 are nestled within adjacent parallel side wails 89*a*, 89*b* of the housing (FIGS. 7 and 8). The receiver assembly, housing, cylinder and valve block are relatively fixed by fastening devices 26, 27, and 28.

BARREL ASSEMBLY

Figure 6:
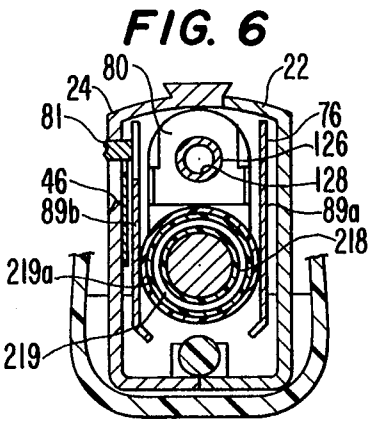
FIG. 6 is a cross sectional view taken along line 6—6 of FIG. 5.
Figure 19:
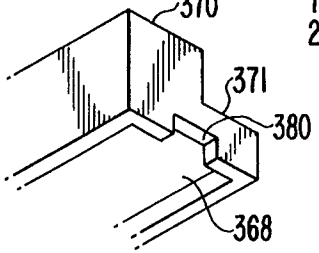
FIG. 19 is a partial lower perspective view of the bolt member of the gun in FIG. 1.

A tubular barrel 126 having a bore 128 is disposed within outer barrel portion 78 and is connected to valve body 92 at barrel connecting cylinder 130 (FIGS. 6 and 11)

PUMP ASSEMBLY AND ACTUATING MECHANISM

Figure 20:
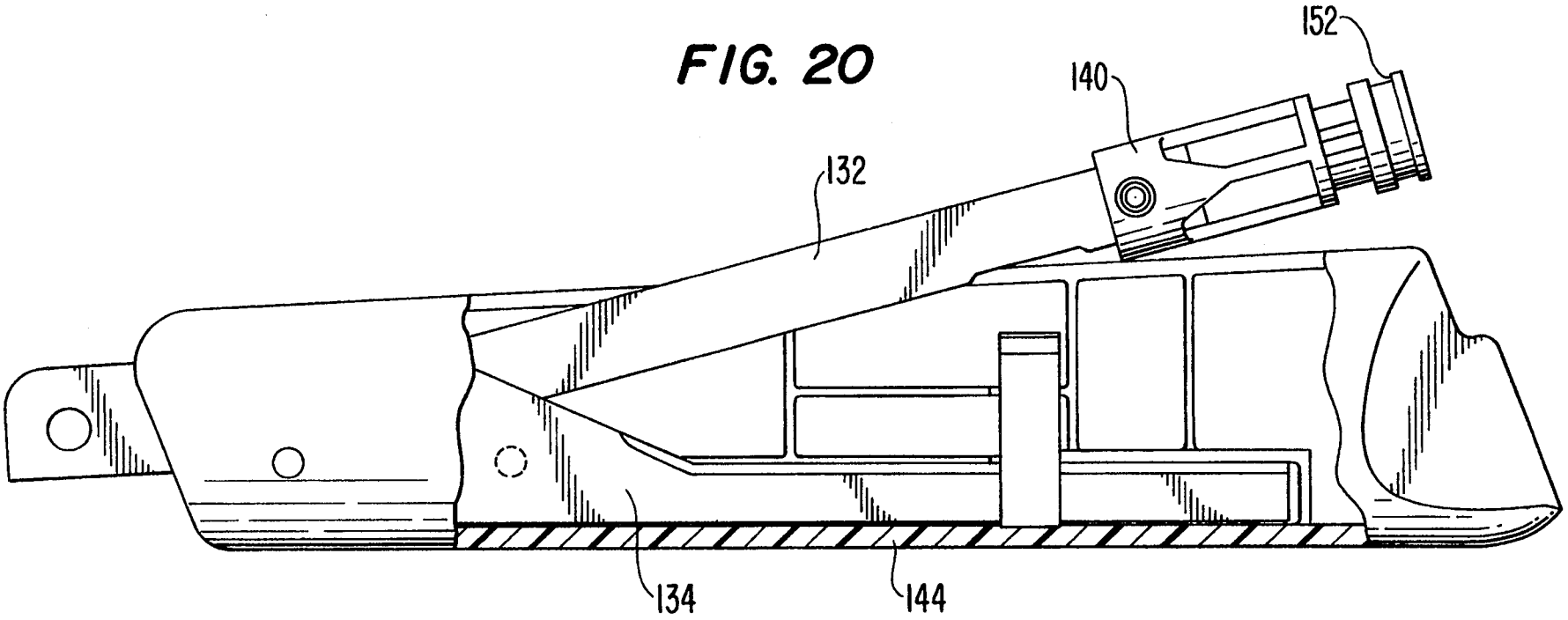
FIG. 20 is a side elevation view, partly in section, of the pumping mechanism of the gun in FIG. 1.

A piston member 140, movable between an extended position (shown in FIGS. 5 and 11) and a retracted position (not shown) is connected by linkage 132 to a pivotally mounted pumping lever 134 for compression of air in a variable volume compression chamber 136 (FIGS. 5, 11, and 20). Mounted onto the pumping lever 134 is a molded plastic forearm 144 which the gun user grips during pumping operations. Piston member 140 has an O-ring type sealing member 150 mounted in groove 152 on the periphery of the piston and lubricating felt washer 154 mounted circumjacent the piston member 140.

Figure 2:
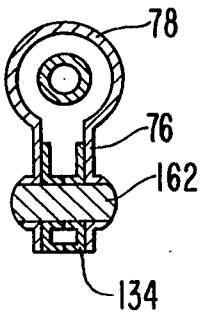
FIG. 2 is a cross sectional view taken along line 2—2 of FIG. 1.

The piston member 140 is reciprocally operable in the cylinder 90 by means of linkage 132 which is pivotally attached on its forward end to the pumping lever 134 by means of pin 160 (FIG. 3) and on its rearward end to piston member 140 by pin 148 (FIG. 4). Pumping lever 134 is attached at its forward end to housing 76 by means of pin 162 (FIG. 2)

AIR AND CARBON DIOXIDE SUPPLY SYSTEM

A compressed gas storage chamber 216 is provided between check valve 218 and firing valve 220 (FIGS. 5 and 11). O-ring 95 is disposed around flange portion 94 of valve body 92 to further seal off storage chamber 216. Valve body 92 has central bore 226 having larger diameter portion 228 and smaller diameter portion 230. Abutment member 232 is disposed in cylinder 90 and has check valve 218 disposed around it. Abutment 232 has rod portion 236 which extends into larger portion 228 of central bore 226. Check valve 218 is held in place by spring 227 disposed between the annular groove 219 (FIG. 6) of check valve 218 and the forward end of valve body 92. Air is allowed to pass between the perimeter of rod portion 236 and central bore 226. Thus, a continuous storage chamber is formed from behind check valve 218 up to firing valve 220. Abutment 232 is held in place by means of a pin (not shown) which extends through aperture 238 in rod portion 236 and through corresponding apertures (not shown) running through the walls of flange portion 94.

Firing valve member 240 is biased by spring 242 to close firing valve 220. Valve member 240 has actuating rod member 244 extending rearward through bore 245 formed in valve body 92. Rod member 244 is struck by the hammer during firing operations to momentarily open firing valve 220 to allow compressed gas into passage 246, and thus, into barrel 126 to propel the BB or pellet. A plug 247 is fastened in the bottom of passage 246. The plug prevents the escape of compressed gas out the bottom portion of passage 246. Immediately after rod member 244 is struck, spring 242 biases valve member 240 back into place thus providing the momentary opening and closing of firing valve 220 needed to fire the BB or pellet.

When the gun is in its pneumatic mode, (as shown in FIG. 5) air is forced into the storage chamber 216 by the reciprocating action of piston member 140. Air passes around the perimeter of abutment 232 and deforms the annular wall 219*a* of check valve 218. Thus, air passes into and is stored in storage chamber 216. Further, when the gun is in the pneumatic mode, the carbon dioxide access port 248 disposed in portion 230 of bore 226 is sealed off from access to carbon dioxide and from access to the atmosphere. Thus, successive reciprocation of piston member 140 builds up the pressure in storage chamber 216 by forcing air through check valve 218. Thereafter, compressed air is released by the momentary opening of firing valve 220 cause by the hammer striking actuating rod member 244. The compressed air passes through passage 246 and into barrel 126 via passage 246 to propel the BB or pellet.

When the gun is in its carbon dioxide mode, (as shown in FIG. 11) carbon dioxide is supplied to the compressed gas storage chamber 216 through carbon dioxide access port 248. The carbon dioxide is supplied from the carbon dioxide cartridge 62 through the carbon dioxide valving system as will be described below. The pressure of the carbon dioxide in storage chamber 216 is the same as the pressure in cartridge 62, because they are in fluid communication. A burst of compressed carbon dioxide is released to power a BB or pellet by the momentary actuation of the firing valve 220 caused by the striking of rod member 244 by the hammer. Immediately after the firing valve 220 is opened, it is biased closed by spring 242 and storage chamber 216 is again automatically supplied carbon dioxide at the pressure of cartridge 62. There is no need for the gun user to actuate any mechanism to recharge storage chamber 216 when the gun is in the carbon dioxide mode. Thus, in the carbon dioxide mode, the pressure of the gas in storage chamber 216, and thus, the pressure used to power the BB or pellet is determined by the pressure in compressed gas cartridge 62.

THE PNEUMATIC/CARBON DIOXIDE SWITCHING SYSTEM

Figure 12:
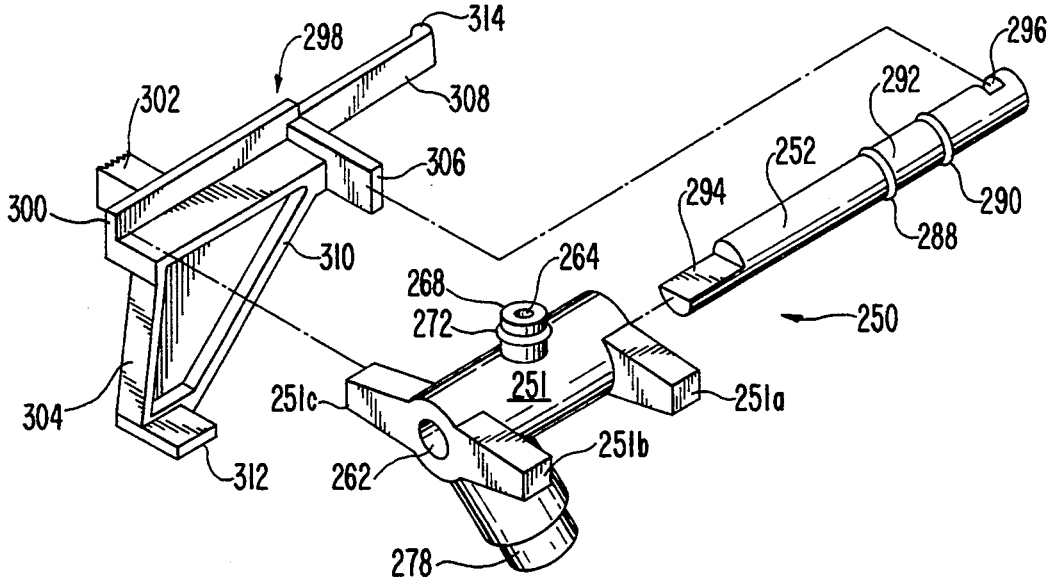
FIG. 12 is an exploded perspective view of the switching system of the gun in FIG. 1.

Spool valve 250 is disposed in the receiver assembly 20 below the valve body 92. Spool valve 250 consists of valve body 251 and spool member 252. Valve body 25 1 is made of metal but can be made of any other suitable material. Spool member 252 is made of plastic but can also be made of any other suitable material. Valve body 251 has three bosses 251*a*, 251*b*, 251*c* which are positioned below ribs 70 disposed on the inner surfaces of receiver halves 22 and 24 (FIGS. 5, 11 and 12). Thus, these bosses position the valve body 251 in the center of receiver assembly 20. Valve body 251 has central bore 262, upper bore 264, and lower bore 266. Upper bore 264 is in communication at its upper end to carbon dioxide access port 248 and at its lower end with central bore 262. Access port 248 and upper bore 264 are held in communication by the insertion of flange 268 of spool valve body 251 into a socket on valve body 92. O-ring 272 is positioned around flange 268 to ensure sealed connection between upper bore 264 and access port 248. Lower bore 266 has an upper end in communication with central bore 262 and has an enlarged lower portion in which is disposed puncture pin 276. Puncture pin 276 has carbon dioxide entry port 277 through which carbon dioxide flows from cartridge 62 into to lower bore 266. Puncture pin 276 is held in place by holding body 278. The lower portion 274 of lower bore 266 has threads on its inner surface which allow holding body 278 to be screwed into the lower end of lower portion 274. Holding body 278 also holds face seal 280 on the bottom portion of puncture pin 276. Seal 280 ensures a tight seal between carbon dioxide cartridge 62 and carbon dioxide entry port 277 (and thus, lower bore 266) after the cartridge is punctured by the puncture pin. An O-ring is positioned around holding body 280 and in an annular cut out portion of spool valve body 251 to ensure a seal between holding body 280 and spool valve body 251.

Spool member 252 is disposed in central bore 262 and has grooves 284 and 286 in which are disposed O-rings 288 and 290, respectively. Spool member 252 can be moved forwardly and rearwardly within central bore 262. A segment 292 of spool member 252 is defined in between O-rings 288 and 290. The diameter of segment 292 is small enough in relation to the diameter of central bore 262 such that carbon dioxide can flow around segment 292. O-rings 288 and 290 provide a seal on each end of segment 292 of spool member 252. Thus, carbon dioxide can flow around segment 292 but cannot escape through the ends of central bore 262 because of O-rings 288 and 290. Spool member 252 has cut out portion 294 at is forward end for locking pumping lever 134 in place when the gun is in its pneumatic mode. Spool member 252 also has slot 296 for engagement with the switch.

Switch 298 is positioned in between valve body 251 and receiver half 22. Switch 298 is made of plastic but can be made of any other suitable material. Switch 298 has rectangular portion 300, finger actuating tab 302, cartridge block member 304, spool engaging tab 306, and stop arm 308. Rectangular portion 300 fits under rib 70 on receiver half 22. Thus, the space between rib 70 and the bottom of receiver half 22 provides a sliding guide for switch 298. Finger actuating tab 302 is disposed in switch aperture 69 and is actuated by the gun user's hand to switch between pneumatic and carbon dioxide modes.

Cartridge blocking member 304 has downwardly extending angular member 310 and rectangular block 312. When the gun is in the pneumatic mode (FIGS. 5 and 13), block 312 prevents insertion of cartridge 62 by preventing access to puncture pin 276, and thus, entry pert 277. However, block 312 does allow access to puncture pin 276 when the gun is switched to the carbon dioxide mode FIGS. 11 and 14).

Spool engaging tab 306 engages slot 296 on the spool. Thus, when switch 298 is forced forwardly, the spool member 252 is also forced forwardly. Further, as switch 298 is moved rearwardly the spool member 252 is also moved rearwardly. Stop arm 308 has hump-shaped portion 314 on its rearward end. Portion 314 engages switch holding grooves 72 and 74 when the gun is in the carbon dioxide and pneumatic modes, respectively. When switch 298 is installed in the gun, stop arm 308 is slightly deflected inward such that when portion 314 is positioned over one of grooves 72, 74 it is biased into such groove.

Figure 13:
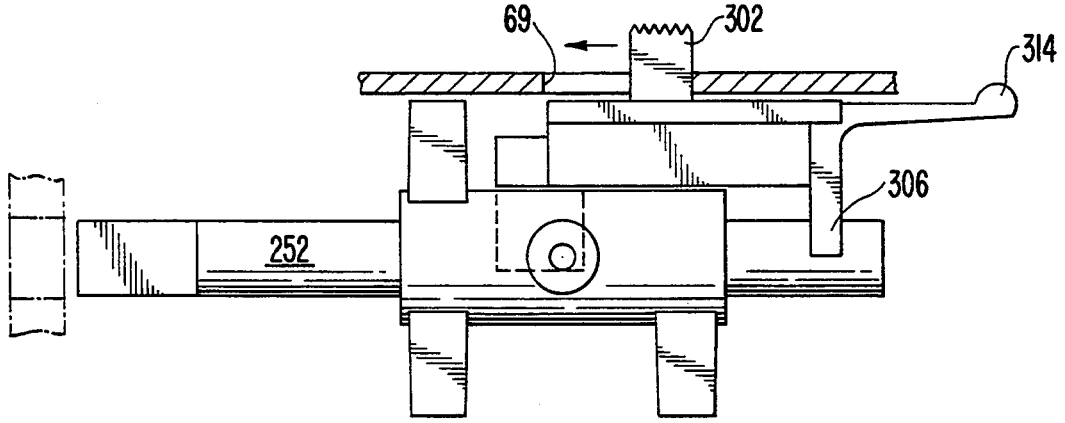
FIG. 13 is a top plan view of the switching system of the gun in FIG. 1 when the gun is in the pneumatic mode of operation.

The spool member position in the pneumatic mode is shown in FIGS. 5 and 13. In this mode, spool member 252 is in its rearward position. Segment 292 of spool member 252 is positioned under upper bore 264 but is not positioned over lower bore 266. Thus, O-rings 288 and 290 seal off carbon dioxide access port 248. When piston 140 is reciprocated in cylinder 90, air is forced through check valve 218 and into storage chamber 216. Because access port 248 is sealed by the position of segment 292, the pressure within storage chamber 216 increases with the reciprocation of piston 140. Additionally, in the pneumatic mode, portion 314 of stop arm 308 is positioned in groove 74 and block 312 of switch 298 prevents the insertion of a carbon dioxide cartridge.

Figure 14:
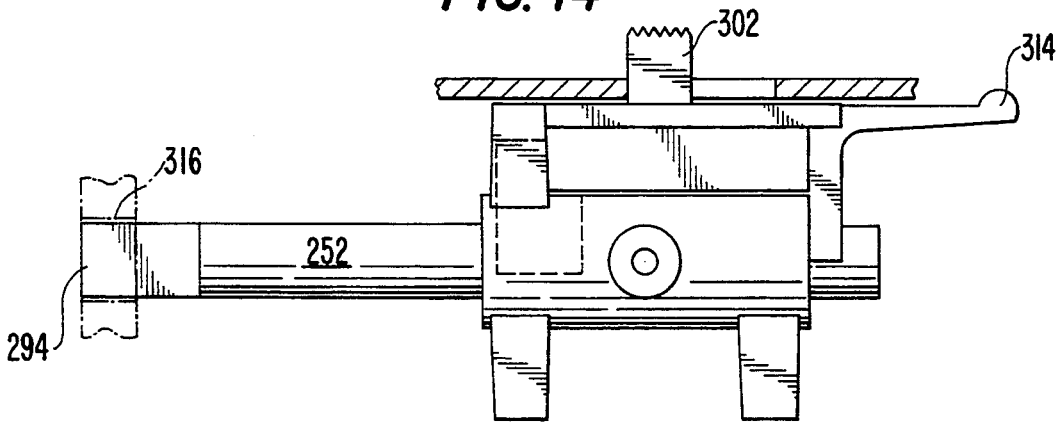
FIG. 14 is a top plan view of the switching system of the gun in FIG. 1 when the gun is in the carbon dioxide mode of operation.
Figure 15:
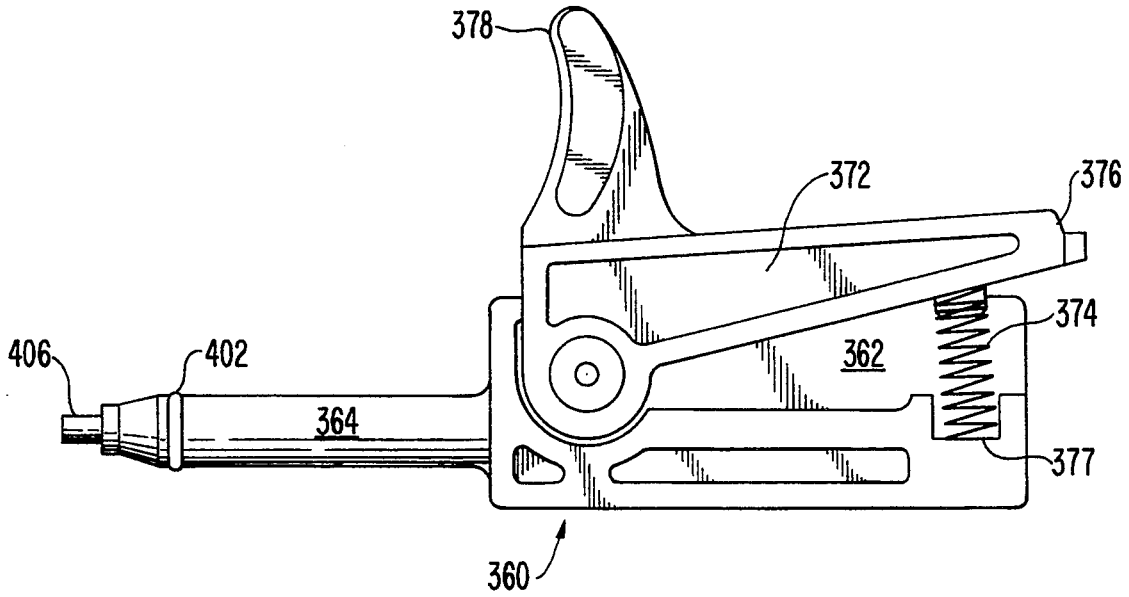
FIG. 15 is a top plan view of the bolt member of the gun in FIG. 1.

The spool member position in the carbon dioxide mode is shown in FIGS. 11 and 14. In this mode, spool member 252 is in its forward position. Segment 292 of spool member 252 is positioned below upper bore 264 and above lower bore 266. Thus, gas communication is allowed between lower bore 266 and upper bore 264 around segment 292. Block 312 of switch 298 allows insertion of a carbon dioxide cartridge into magazine 58. Cartridge 62 is forced upwardly by screwing plug 68 upwardly such that cartridge 62 is punctured by puncture pin 276. The nose 63 of the cartridge is forced against seal 280 so that cartridge 62 is in sealed communication with entry port 277, and thus, lower bore 266. Thus, carbon dioxide gas is supplied to storage chamber 216 from cartridge 62 via entry port 277, lower bore 266, the space between segment 292 of spool member 252 and central bore 262, upper bore 264, and access aperture 248. The carbon dioxide in storage chamber 216 is at the same pressure as the carbon dioxide in cartridge 62. After the momentary opening and closing of firing valve 220, additional carbon dioxide passes to storage chamber 216 from cartridge 62, thus, preparing the gun to fire another projectile in response to the opening of firing valve 220.

Figure 16:
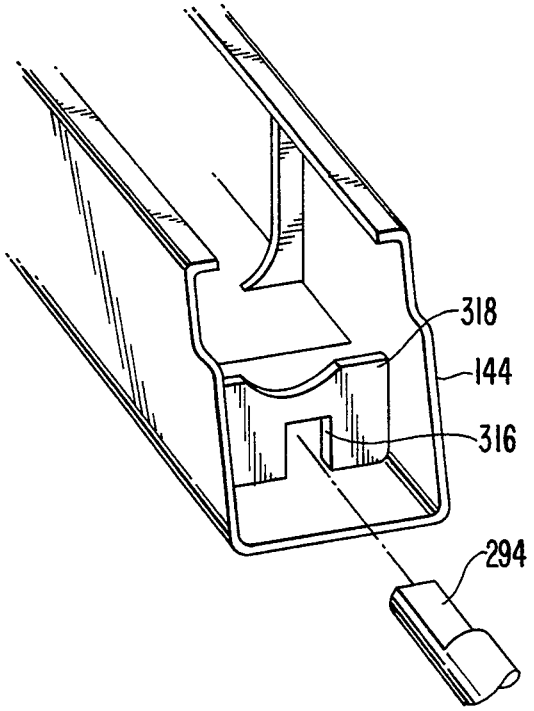
FIG. 16 is partial exploded perspective view of the forearm and spool valve member of the gun in FIG. 1.

Further, when the gun is in the carbon dioxide mode, cut out portion 294 of spool member 252 engages locking aperture 316 on rib 318 of molded plastic forearm 144 (FIGS. 11, 14 and 16). This engagement of portion 294 with aperture 316 locks the pumping lever 134 in place when the gun is in the carbon dioxide mode. Additionally, when a cartridge is inserted in magazine or holder 58, the nose of the cartridge prevents switch 298 from being moved to its rearward position corresponding to the pneumatic mode of the gun. If switch 298 is attempted to be moved rearwardly, block 312 engages the nose of cartridge 62 thus preventing rearward movement (FIG. 11). Therefore, when a carbon dioxide cartridge is inserted into magazine 58, the gun is locked in the carbon dioxide mode (with pumping lever 134 locked in position) until the cartridge is removed from magazine 58.

The switching system also performs a venting of storage chamber 216 when switching from the pneumatic mode to the carbon dioxide mode and vice versa. When the gun is switched from the pneumatic to the carbon dioxide mode, switch 298 is moved forward thus moving spool member 252 forward. Any residual compressed air remaining in storage chamber 216 is vented to the atmosphere via access aperture 248, upper bore 264, the space between segment 292 of spool member 252 and central bore 262, lower bore 266, and entry port 277. A carbon dioxide cartridge can then be inserted into magazine 58. When switching from the carbon dioxide mode to the pneumatic mode, cartridge 62 is first removed thus allowing any residual carbon dioxide in storage chamber 216 to be vented to the atmosphere via access aperture 248, upper bore 264, the space between segment 292 of spool member 252 and central bore 262, lower bore 266, and entry port 277. Switch 298 is then moved rearward to seal off lower bore 266 and entry port 277 from the atmosphere, and thus, seal off storage chamber 216 so that air can be compressed in storage chamber 216 by reciprocating piston 140.

COCKING AND FIRING SYSTEM

The firing valve 220 is operated by being momentarily struck by hammer 316. Hammer 316 is slidably supported in cylinder 318 formed by valve body 92 and valve cover 93 (FIGS. 5 and 8). Hammer 316 has forward flange 317 and rear flange 319. Hammer 316 is biased forward by spring 320. When the gun is in its uncooked position, spring 320 positions the forward surface of forward flange 317 against the rearward end of actuating rod member 244 of valve member 240. In this position, spring 320 is under slight compression. The rearward end of spring 320 is attached to valve body 92. Sear 322 is pivotally mounted on pin 324 of valve body 92. Sear 322 has forwardly extending arm 326 with safety catch 328 and firing catch 330. Both catches 328 and 330 engage rear flange 319 of hammer 316. Firing catch 330 holds hammer 316 in the firing positions with spring 320 compressed. Safety catch 328 prevents the hammer from striking actuating rod member 244 if rear flange 319 is disengaged from firing catch 330 by an accidental dropping of the gun. Additionally, if the gun is accidentally dropped, safety catch 328 prevents the hammer from opening firing valve 220 when the hammer is in its uncocked position. When the gun is accidentally dropped on the rear end of the stock and the hammer is uncocked, the hammer compresses spring 320 on impact. As spring 320 is compressed, safety catch 328 catches on rear flange 319, thus preventing the hammer from being propelled forward by spring 320 to open firing valve 220. Sear 322 also has trigger abutment 332 and is biased in the upward direction by spring 334 attached to arm 326. The bottom end of spring 334 is supported against surface 336 of receiver assembly 20.

Trigger 340 is also pivotally mounted on pin 324 (FIGS. 5 and 9). Trigger 340 has forward extending arm 342, upward extending arm 344, and finger actuating arm 346. Finger actuating arm 346 is actuated by the gun's user to cause the firing of the gun. Pulling of arm 346 rearward causes forwardly extending arm 342 downward. Arm 342 engages trigger abutment 332 of sear 322 to rotate sear arm 326 downwardly against spring 334 to release firing catch 330 from rear flange 319 of hammer 316, thus allowing hammer 316 to be propelled forwardly to strike actuating rod member 244 to momentarily open firing valve 220. The opening of firing valve 220 allows the compressed air or carbon dioxide (depending on the mode of operation) in storage chamber 216 into barrel 126 to propel a projectile. As discussed above, in the uncocked position, spring 320 positions the front surface of hammer 316 against actuating rod member 244. However, the compression in spring 320 is not large enough to overcome the compression in spring 242 to open firing valve 220. However, when the gun is cocked and fired, the mass of hammer 316 being propelled from its firing position by the further compression of spring 320 applies sufficient force to actuating rod 244, and thus opens firing valve 220. After striking actuating rod member 244, spring 320 returns to its uncocked position. Safety mechanism 348 is positioned in receiver assembly 20 for preventing accidental rotation of trigger 340.

Trigger block 350 is pivotally positioned in between valve body 92 and valve cover 93 (FIGS. 5, 9 and 10). Trigger block 350 has an upper horizontal arm 352 and downward extension 354. Spring 356 is positioned in and is under compression between downward extension 354 and upward arm 344 of trigger 340. Spring 356 biases both trigger block 350 and trigger 340 in a clockwise direction. Horizontal arm 352 is positioned in trigger block slot 357 formed by valve body 92 and valve cover 93. The rearward end of horizontal arm 352 has a detent 355 for engaging the upper edge of upward arm 344 of trigger 340. The forward end of horizontal arm 352 has an upward turned bolt engaging portion 358.

Bolt member 360 comprises a generally hollow body portion 362 of generally rectangular peripheral configuration and a forwardly extending cylindrical portion 364 integrally formed of molded plastic material (FIGS. 5, 8, 9, 10 and 15). The body portion has on its lower surface 365 a downwardly extending cocking flange 366 and a hollowed out portion 368. Cocking flange 366 extends through hammer cocking slot 114 and lower surface 365 slides along bolt slide surface 110 formed by fib 108 of valve cover 93, upper wall 106 of valve body 92, and fib 50 of receiver half 22. Cocking flange 366 has surface 368 for engaging rear flange 319 of hammer 316. The upper surface 370 of the body portion of the bolt has a cavity 371 in which is pivotally mounted a bolt handle 372. Bolt spring 374 is positioned in between bolt handle 372 and vertical surface 377 of body portion 362. Spring 374 is under compression and biases bolt handle 372 outwardly. Upper surface 370 of body portion 362 is positioned in upwardly extending hood 116 of valve cover 93 which provides elongated bolt guideway 117 so that the bolt can be slidably moved within the guideway. Bolt handle 372 has raised portion 376 and finger actuating protrusion 378 which extends through bolt handle opening 42. The bolt can be positioned in a fully forward firing position, or in a rearward loading and cocking position. The bolt body portion 362 slides along bolt slide surface 110 and within bolt guideway 116 in between these two positions. When the bolt is in the ready to fire position, raised portion 376 of bolt handle 372 protrudes through bolt handle opening 42 so that the bolt is "snapped" into position because of the engagement of raised portion 376 with the edges of opening 42. In order to move the bolt rearwardly, finger actuating protrusion 378 is pulled rearwardly thus pivoting bolt handle 372 against spring 374. This pivoting action unseats raised portion 376 from bolt handle opening 42 and allows the bolt to be moved rearwardly.

When the bolt is in the rearward cocking and loading position, hollowed out portion 368 (FIG. 19)allows spring 356 to bias trigger block 350 to pivot in the clockwise direction because the forward end of horizontal arm 352 extends into the hollowed out portion 368. When trigger block 350 is rotated in the clockwise direction, detent 355 on the rearward end of horizontal arm 352 engages the upper edge of upward arm 344 of trigger 340, and thus, prevents trigger 340 from being rotated in the clockwise direction. As the bolt is moved into the ready to fire position, back edge 380 of hollowed out portion 368 engages upward turned bolt engaging portion 358 of horizontal arm 352 to pivot trigger block 350 in the counter clockwise direction. Engaging portion 358 and back edge 380 engage each other only shortly before the bolt has reached its most forward position. This pivoting action disengages detent 355 from the upper edge of upward arm 344 of trigger 340, thus allowing trigger 340 to be rotated in the counter clockwise direction to fire the gun. The interaction between the bolt and trigger block 350 allows the trigger to be operated when in the bolt is in the firing position but blocks the trigger from operation during the cocking and loading of the gun.

Cylindrical portion 364 is centrally located relative to the body portion and extends forwardly from the front wall thereof in axial alignment with the barrel bore 128. A sealing O-ring 402 is position around cylindrical portion 364 in a slot at the front end of the bolt so as to seal the rear end of the barrel bore. A magnetic pin 406 is fixedly mounted on the forward end of cylindrical portion 364 to position a pellet or BB in the firing position as shown in FIG. 11.

OPERATION

When the gun is in the pneumatic mode (FIGS. 5 and 13), switch 298 is in its rearward position. Thus, block 312 prevents insertion of a carbon dioxide cartridge by preventing access to puncture pin 276, and thus entry port 277. Portion 314 of stop arm 308 is in holding groove 74. Spool member 252 is positioned in its rearward position within spool valve body 251 so that lower bore 266 is sealed off from upper bore 264 (and thus access port 248) because of the position of segment 292. In order to compress air in storage chamber 216, pumping lever 134 is actuated to move piston member 140 in cylinder 90. As piston member 140 reaches its most forward position, atmospheric air is supplied to compression chamber 136. As the piston member is moved rearward, air is forced around the perimeter of abutment 236 and by check valve 218 by deforming annular wall 219. Successive reciprocating of piston member 140 in cylinder 90 by pumping lever 134 forces more air by check valve 218 and into storage chamber 216, thus increasing the pressure within storage chamber 216. After a desired number of pumps, storage chamber 216 has a supply of compressed air ready for release to power a projectile. The gun can then be cocked and loaded.

Assuming the gun has just been fired, the bolt and the hammer are both in their forward positions. Bolt 360 is moved rearwardly by the gun user pulling rearward on finger actuating protrusion 378. As the bolt is moved rearwardly, surface 368 of cocking flange 366 engages the front surface rear flange 319 of hammer 316, thus moving the hammer rearwardly and compressing spring 320. Rear flange 319 of hammer 316 engages the front of arm 326 of sear 322 deflecting arm 326 downwardly against spring 334. Hammer 316 is moved rearwardly until rear flange 319 engages firing catch 330. Firing catch 330 is biased upwardly to engage rear flange 319 by spring 334. Thus, hammer 316 is held in its cocked position. Additionally, as bolt 360 is moved rearwardly, portion 358 of trigger block 350 is positioned in hollowed out portion 368. Thus, trigger block 350 is allowed to rotate in the clockwise direction so that detent 355 of trigger block 350 engages the upper edge of arm 344 of trigger 340 to prevent trigger 340 from rotating counter clockwise. A BB or pellet is then positioned in access opening 44. The BB is attracted to magnetic pin 406 of cylindrical portion 400 of bolt 360. Bolt 360 is then moved forwardly by the operator. As bolt 360 is moved forwardly, hammer 316 remains in its cocked position. As the bolt nears its forward position, back edge 380 of hollowed out portion 368 engages engaging portion 358 of the trigger block to rotate trigger block 350 in the counter clockwise direction. As trigger block 350 is rotated, detent 355 disengages the arm 344, thus allowing the trigger to be rotated. When the bolt is in the forward position, the BB or pellet is positioned in barrel bore 128 in front of passage 246. The gun is now ready to fire.

In order to fire the gun, finger actuating arm 346 of trigger 340 is pulled rearwardly by the gun user. As the trigger is rotated in the counter clockwise direction, arm 342 engages trigger abutment 332 of sear 322 thus rotating the sear downwardly. As sear 322 is rotated downwardly, firing catch 330 releases rear flange 319 allowing the hammer to be propelled forwardly. As the hammer reaches its most forward position, forward flange 317 engages actuating rod member 244 of firing valve member 240. This engagement opens firing valve 220, thus allowing the compressed air to flow through passage 246 and into barrel 126 to propel the BB or pellet. Firing valve member 240 is moved forwardly and thus compresses firing spring 242. Spring 242 immediately closes firing valve 220 after rod member 244 has been struck by hammer 316. Hammer 316 is returned to its uncocked position. The gun can then be refired by following the same procedures.

In order to switch from the pneumatic mode to the carbon dioxide mode (FIGS. 11 and 14) the operator, with the pumping lever 134 in the stowed position, moves finger actuating protrusion 302 of switch 298 forwardly. As switch 298 is moved forwardly, spool member 252 is also moved forwardly because of the engagement between spool engaging tab 306 of switch 298 and slot 296 of spool member 252. In the switch's forward position, portion 314 of stop arm 308 of switch 298 engages holding groove 72 and block 3 12 no longer prevents access to puncture pin 276. When spool member 252 is in its forward position, lower bore 266 and upper bore 264 of spool valve body 251 are in communication through segment 292 of spool member 252, thus allowing communication between storage chamber 216 and entry port 277. Because a carbon dioxide cartridge 62 has not yet been inserted, any remaining compressed air in storage chamber 216 is vented to the atmosphere via access port 248, upper bore 264, segment 292, lower bore 266, and entry port 277. Further, when spool member 252 is in its forward position, cut out portion 294 engages locking aperture 316 on fib 318 of molded plastic forearm 144, thus preventing actuation of pumping lever 134.

A carbon dioxide cartridge 62 is now ready to be inserted into magazine 58. Nose 63 of cartridge 62 is positioned against seal 280. Plug 68 is threaded into threaded aperture 66. As plug 68 is screwed upwardly, cartridge 62 is forced upwardly thus compressing seal 280. As cartridge 62 is forced upward, puncture pin 276 begins to puncture the top of cartridge 62. Thus, the compressed carbon dioxide in cartridge 62 is now in fluid communication with storage chamber 216 via entry port 277, lower bore 266, the space between segment 292 of spool member 252 and central bore 262, upper bore 264, and access port 248. The pressure of the carbon dioxide that flows to storage chamber 216 is at the same pressure as the gas remaining in cartridge 62. Thus a supply of compressed gas is in storage chamber 216 ready to be released to propel a projectile. The gun is now ready to be cocked and loaded. The cocking and loading operations are the same as those described above with regard to the pneumatic mode.

The firing operations are essentially the same as those of the pneumatic mode. Hammer 316 strikes rod member 244 to momentarily open firing valve 220. Firing valve 220 is then immediately closed by spring 242. This momentary opening and closing of firing valve 220 allows a burst of carbon dioxide into storage chamber 216 to propel a projectile via passage 246. After firing valve 220 closes, storage chamber 216 is immediately supplied with more carbon dioxide from cartridge 62. Thus, after further cocking and loading operations the gun is again ready to fire. When the gun is in the carbon dioxide mode and after the gun has been fired, there is no need for the operator to actuate any sort of mechanism to resupply carbon dioxide to the storage chamber. The storage chamber is automatically resupplied with carbon dioxide at the same pressure as the carbon dioxide remaining in cartridge 62.

The first step in switching from the carbon dioxide mode back to the pneumatic mode is to remove plug 68 and cartridge 62. As cartridge 62 is removed, any residual carbon dioxide in storage chamber 216 is vented to the atmosphere through entry port 277. Switch 298 and spool member 252 are then moved rearwardly into the pneumatic mode position, thus unlocking pumping lever 134, positioning block 312 over puncture pin 276, and sealing off lower bore 266.

While the above embodiment describes a compressed gas rifle using air or compressed gas as a power source, the invention disclosed herein would work equally as well with other gun configurations, such as a pistol configuration, and with compressed gases other that carbon dioxide. Further, although the gun disclosed herein is described as propelling BB's or pellets, the invention will work as well with other types of projectiles.

Numerous characteristics and advantages of the invention have been described in detail in the foregoing description with reference to the accompanying drawings. However, the disclosure is illustrative only and the invention is not limited to the precise illustrated embodiment. Various changes and modifications may be effected therein by one skilled in the art without departing from the scope and spirit of the invention.

I claim:

1. A gun for propelling a projectile using compressed gas comprising:

a gun body;

a barrel attached to said gun body and having a bore through which the projectile is propelled;

a compressed gas storage chamber disposed in said gun body and in fluid communication with said barrel bore through a passage when the gun is fired;

a firing valve for allowing the compressed gas in said storage chamber to pass through said passage to said barrel bore to propel the projectile, said firing valve opening in response to the firing of the gun;

a compression chamber in fluid communication with said storage chamber through a check valve and having a piston disposed therein, said piston reciprocable in said compression chamber to compress atmospheric air, said check valve allowing air compressed in said compression chamber by the reciprocation of said piston to pass into said storage chamber;

an access port disposed in said storage chamber;

a compressed gas cartridge holder adapted to hold a compressed gas cartridge;

an entry port in fluid communication with the compressed gas cartridge when the cartridge is held in said cartridge holder, said access port in fluid communication with said entry port; and a switching valve disposed in said gun body and actuatable by a gun operator between a first and second positions, said first position allowing fluid communication between said entry port and said access port such that compressed gas continuously flows from the cartridge to said storage chamber when the compressed gas cartridge is disposed in said cartridge holder and such that the flow of gas from the cartridge to the storage chamber is uninterrupted whenever the switching valve is in its first position, said second position preventing fluid communication between said entry port and said access port.

2. The gun of claim 1 wherein said switching valve is comprised of a switching valve body and a switching valve member disposed in said switching valve body, said switching valve member having a first position corresponding to said first position of said switching valve and a second position corresponding to said second position of said switching valve.

3. The gun of claim 2 further including a switch member disposed in said gun body and engaging said switching valve member such that the gun operator actuates said switch member to move said switching valve member between its first and second positions.

4. The gun of claim 3 wherein said switch member has a blocking member and wherein, when said switching valve member is in its second position, said blocking member prevents fluid communication between said entry port and said compressed gas cartridge so that insertion in said cartridge holder is prevented.

5. The gun of claim 4 wherein said blocking member prevents said switching valve member from being moved from its first position to its second position when a cartridge is inserted in said cartridge holder, said blocking member abutting against said cartridge to prevent such movement.

6. The gun of claim 2 wherein said valve body has a first bore in fluid communication with said access port and a second bore in fluid communication with said entry port and wherein said switching valve member allows fluid communication between said first and second bores when said switching valve member is in its first position and prevents fluid communication between said first and second bores when said switching valve member is in its second position.

7. The gun of claim 2 wherein said switching valve member includes preventing means for preventing reciprocation of said piston in said compression chamber when said switching valve member is in its first position.

8. The gun of claim 2 wherein said piston is reciprocated in said compression chamber by a pivotally mounted pumping lever and wherein said switching valve member includes preventing means for preventing said pumping lever from reciprocating said piston when said switching valve member is in its first position.

9. The gun of claim 1 further including preventing means for preventing the reciprocation of said piston in said compression chamber when said switching valve is in its first position.

10. The gun of claim 1 further including preventing means for preventing fluid communication between said entry port and the cartridge such that insertion of the cartridge in the cartridge holder is prevented when said switching valve is in its second position.

11. The gun of claim 1 wherein the compressed gas in the cartridge is carbon dioxide.

12. The gun of claim 1 wherein said switching valve is a spool valve.

13. In a gun for propelling a projectile, the gun having a first mode of operation for propelling the projectile by compressed gas contained within a cartridge and a second mode of operation for propelling the projectile by air compressed by a self contained pumping mechanism, a switching system for switching between the first and second modes, comprising:

a valve having a first position corresponding to the first mode of operation and a second position corresponding to the second mode of operation, said first position only allowing compressed gas from the cartridge to propel the projectile and said valve remaining in the first position at all times when the gun is in its first mode of operation, said second position preventing compressed gas from the cartridge from propelling the projectile and only allowing compressed air from the pumping mechanism to propel the projectile; and a switch member for positioning said valve in said first and second positions, said switch member actuated by the gun operator to switch the gun between the first and second modes.

14. The switching system of claim 13 wherein said valve has a valve body and a valve member disposed in said body, said valve member movable between a first position corresponding to said first position of said valve and a second position corresponding to said second position of said valve.

15. The switching system of claim 14 wherein said valve body has a first bore and a second bore and wherein said first and second bores are in fluid communication when said valve member is in its first position and said first and second bores are not in fluid communication when said valve member is in its second position.

16. The switching system of claim 14 wherein said valve member includes preventing means as for preventing actuation of the self contained pumping system when said valve member is in its first position.

17. The switching system of claim 13 wherein said valve is a spool valve.

18. The switching system of claim 13 wherein said switch member has a blocking member which prevents fluid communication between the cartridge and the gun when said valve is in its second position.

19. The switching system of claim 13 wherein the compressed gas contained within the cartridge is carbon dioxide.

20. A gun for propelling a projectile using a compressed gas having a first mode of operation for propelling the projectile by compressed gas contained within a cartridge and a second mode of operation for propelling the projectile by air compressed by a pumping mechanism, the gun comprising:

a gun body;

a barrel attached to said gun body and having a bore through which a projectile is propelled;

a valve body disposed in said gun body, said body having a bore formed therein, said bore connected to said barrel bore by a passage;

a firing valve disposed at the juncture between said passage and said valve body bore, said firing valve allowing fluid communication between said valve body bore and said barrel bore when the gun is fired;

a compression chamber for compressing atmospheric air;

a check valve disposed between said compression chamber and said valve body bore such that a compressed gas storage chamber is formed by said valve body bore and said check valve;

a piston disposed in said compression chamber, said piston reciprocable within said compression chamber to compress atmospheric air, the reciprocation of said piston forcing compressed air through said check valve and into said storage chamber;

an access port disposed in said valve body bore;

a compressed gas entry port adapted to be in fluid communication with a compressed gas cartridge;

a switching valve body disposed in said gun body, said switching valve body having a first bore and a second bore, said first bore is in fluid communication with said access port and said second bore is in fluid communication with said entry port; and a switching valve member having a first position corresponding to the first mode of operation and for allowing continuous fluid communication between said first and second bores and a second position corresponding to the second mode of operation and for preventing fluid communication between said first and second bores and wherein the fluid communication between said first and second bores is uninterrupted whenever said switching valve member is in its first position.

21. A gun for propelling a projectile using compressed gas comprising:

a gun body;

a barrel attached to said gun body and having a bore through which the projectile is propelled;

a compressed gas storage chamber disposed in said gun body and in fluid communication with said barrel bore through a passage when the gun is fired;

a firing valve for allowing the compressed gas in said storage chamber to pass through said passage to said barrel bore to propel the projectile, said firing valve opening in response to the firing of the gun;

a compression chamber in fluid communication with said storage chamber through a check valve and having a piston disposed therein, said piston reciprocable in said compression chamber to compress atmospheric air, said check valve allowing air compressed in said compression chamber by the reciprocation of said piston to pass into said storage chamber;

an access port disposed in said storage chamber;

a compressed gas cartridge holder adapted to hold a compressed gas cartridge;

an entry port in fluid communication with the compressed gas cartridge when the cartridge is held in said cartridge holder, said access port in fluid communication with said entry port;

a switching valve disposed in said gun body and actuatable by a gun operator between a first and second positions, said first position allowing fluid communication between said entry port and said access port such that compressed gas continuously flows from the cartridge to said storage chamber when the compressed gas cartridge is disposed in said cartridge holder, said second position preventing fluid communication between said entry port and said access port;

wherein said switching valve is comprised of a switching valve body and a switching valve member disposed in said switching valve body, said switching valve member having a first position corresponding to said first position of said switching valve and a second position corresponding to said second position of said switching valve;

a switch member disposed in said gun body and engaging said switching valve member such that the gun operator actuates said switch member to move said switching valve member between its first and second positions; and wherein said switch member has a blocking member and wherein, when said switching valve member is in its second position, said blocking member prevents fluid communication between said entry port and said compressed gas cartridge so that insertion in said cartridge holder is prevented.

22. The gun of claim 21 wherein said blocking member prevents said switching valve member from being moved from its first position to its second position when a cartridge is inserted in said cartridge holder, said blocking member abutting against said cartridge to prevent such movement.

23. A gun for propelling a projectile using compressed gas comprising:

a gun body;

a barrel attached to said gun body and having a bore through which the projectile is propelled;

a compressed gas storage chamber disposed in said gun body and in fluid communication with said barrel bore through a passage when the gun is fired;

a firing valve for allowing the compressed gas in said storage chamber to pass through said passage to said barrel bore to propel the projectile, said firing valve opening in response to the firing of the gun;

a compression chamber in fluid communication with said storage chamber through a check valve and having a piston disposed therein, said piston reciprocable in said compression chamber to compress atmospheric air, said check valve allowing air compressed in said compression chamber by the reciprocation of said piston to pass into said storage chamber; an access port disposed in said storage chamber;

a compressed gas cartridge holder adapted to hold a compressed gas cartridge; an entry port in fluid communication with the compressed gas cartridge when the cartridge is held in said cartridge holder, said access port in fluid communication with said entry port;

a switching valve disposed in said gun body and actuatable by a gun operator between a first and second positions, said first position allowing fluid communication between said entry port and said access port such that compressed gas continuously flows from the cartridge to said storage chamber when the compressed gas cartridge is disposed in said cartridge holder, said second position preventing fluid communication between said entry port and said access port; and preventing means for preventing the reciprocation of said piston in said compression chamber when said switching valve is in its first position.

24. A gun for propelling a projectile using compressed gas comprising:

a gun body;

a barrel attached to gun body and having a bore through which the projectile is propelled;

a compressed gas storage chamber disposed in said gun body and in fluid communication with said barrel bore through a passage when the gun is fired;

a firing valve for allowing the compressed gas in said storage chamber to pass through said passage to said barrel bore to propel the projectile, said firing valve opening in response to the firing of the gun;

a compression chamber in fluid communication with said storage chamber through a check valve and having a piston disposed therein, said piston reciprocable in said compression chamber to compress atmospheric air, said check valve allowing air compressed in said compression chamber by the reciprocation of said piston to pass into said storage chamber;

an access port disposed in said storage chamber;

a compressed gas cartridge holder adapted to hold a compressed gas cartridge;

an entry port in fluid communication with the compressed gas cartridge when the cartridge is held in said cartridge holder, said access port in fluid communication with said entry port;

a switching valve disposed in said gun body and actuatable by a gun operator between a first and second positions, said first position allowing fluid communication between said entry port and said access port such that compressed gas continuously flows from the cartridge to said storage chamber when the compressed gas cartridge is disposed in said cartridge holder, said second position preventing fluid communication between said entry port and said access port; and preventing means for preventing fluid communication between said entry port and the cartridge such that insertion of the cartridge in the cartridge holder is prevented when said switching valve is in its second position.

* * * * *